United States Patent [19]

Pugh

[11] 4,123,809

[45] Nov. 7, 1978

[54] PORTABLE CHANGER-SURFACE FOR INFANTS

[76] Inventor: Joan E. Pugh, 322 Roxbury Ct., Joppa, Md. 21085

[21] Appl. No.: 829,063

[22] Filed: Aug. 30, 1977

[51] Int. Cl.[2] ..... A47K 3/12; A47K 3/164

[52] U.S. Cl. ..... 4/185 B; 4/185 R; 128/33

[58] Field of Search ..... 4/173 R, 185 R, 185 B, 4/185 S; 108/112; 312/201

[56] References Cited

U.S. PATENT DOCUMENTS

| | | | |
|---|---|---|---|
| 652,289 | 6/1900 | Powell | 4/185 R |
| 1,358,680 | 11/1920 | Lilly | 4/185 B |
| 1,427,598 | 8/1922 | Jackson | 4/185 BX |
| 1,553,036 | 9/1925 | Foss | 108/112 |
| 1,758,071 | 5/1930 | Bleustein | 4/185 B |
| 2,650,374 | 9/1953 | Pierce | 108/112 X |
| 2,825,911 | 3/1958 | Townsley | 4/185 B |
| 2,903,313 | 9/1959 | Block | 108/112 X |
| 2,974,322 | 3/1961 | Norris | 4/185 B |
| 3,379,145 | 4/1968 | Lieberman | 108/112 |
| 4,037,591 | 7/1977 | Sarno | 4/185 R |

*Primary Examiner*—Henry K. Artis
*Attorney, Agent, or Firm*—John F. McClellan

[57] ABSTRACT

Folding planar structure for use as a changing surface for infants, particularly while away from home. A plural-part rigid board assembly includes a unitary cushioning pad cemented to the parts and hinging them together, and has sliding rod structure for board-to-board connection holding the three parts rigidly in plane when in use; parts of the sliding rod structure are always in view and evidence by position whether the assembly is safely secured together. When folded for storage the sliding rod assembly provides handle structure for carrying and also stand structure preventing the assembly from getting wet or soiled when rested on a floor or leaned against a wall.

8 Claims, 4 Drawing Figures

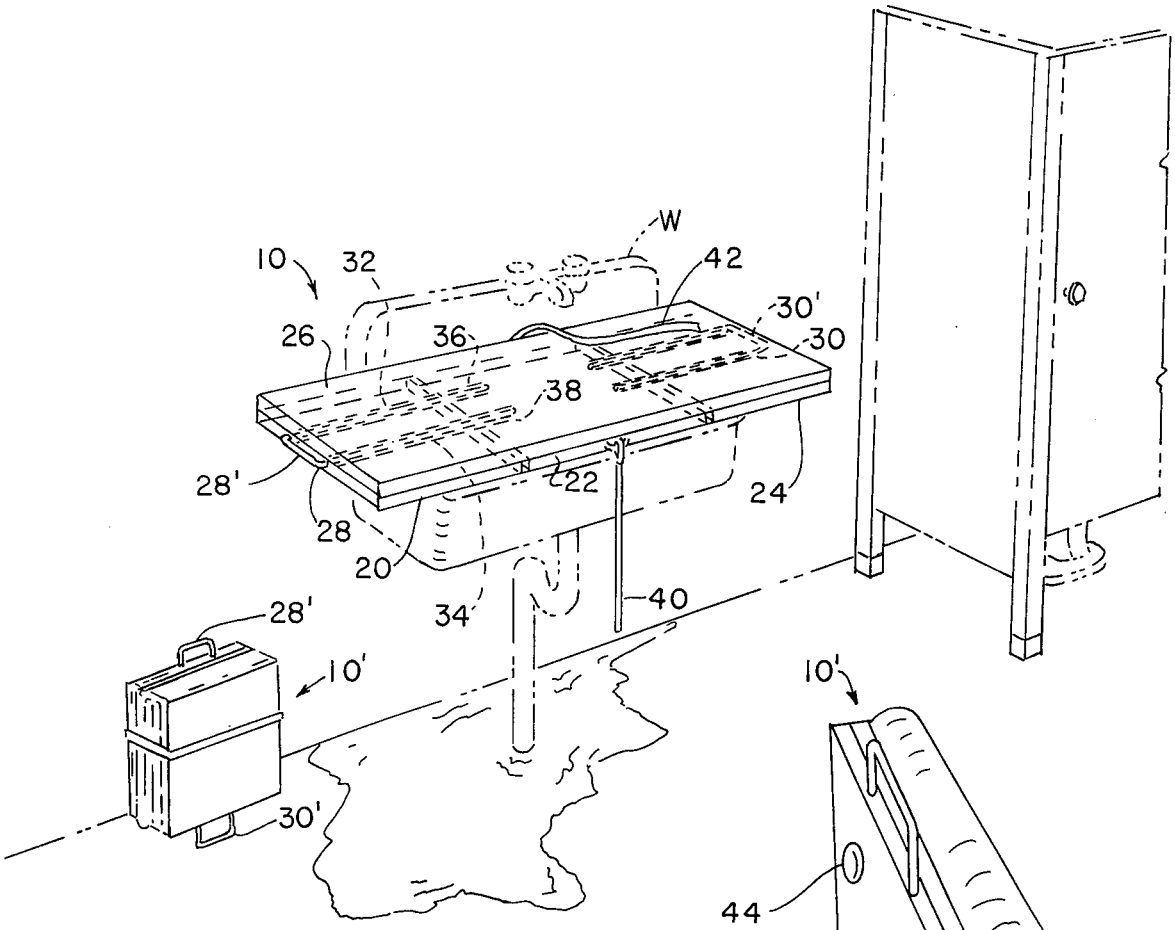
FIG. 1
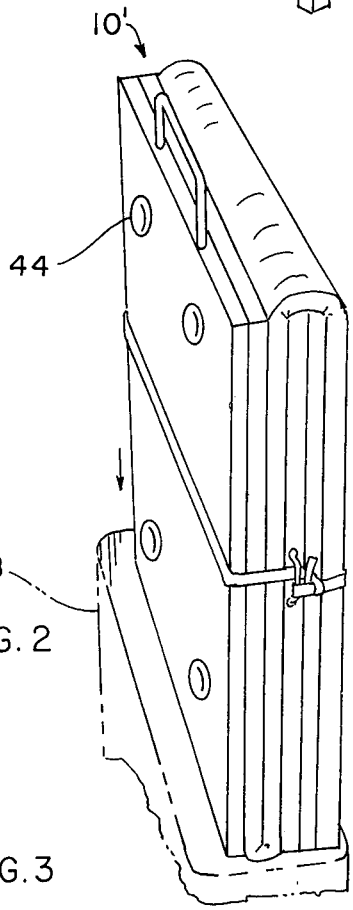
FIG. 2
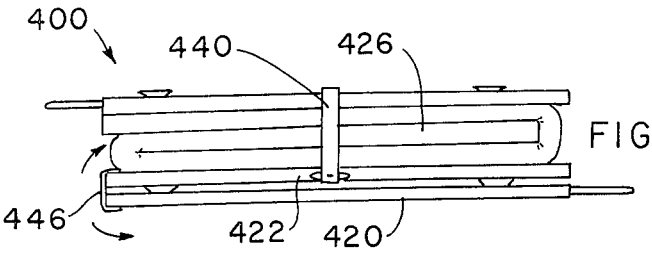
FIG. 4
FIG. 3
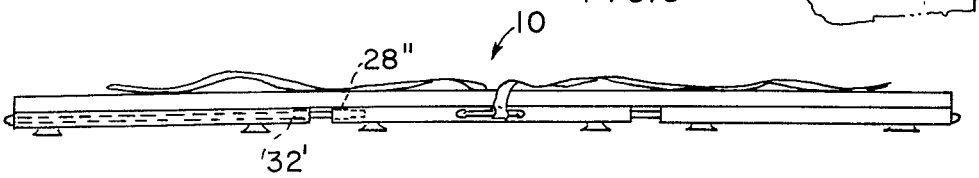

PORTABLE CHANGER-SURFACE FOR INFANTS

This invention relates generally to infant furniture and particularly to folding furniture for use assembled into planar configuration as changing and bathing furniture for infants.

In the prior art various assemblies relating to infant furniture have been disclosed, including those in the following U.S. Pat. Nos.

3,253,293 to E. George et al, 5-3-66
3,162,864 to A. J. Oullette, 12-29-64
2,483,077 to J. C. Walsh, 9-27-49
3,617,418 to Robert C. Miller, 11-2-71

George et al disclose a portable assembly of rectangular units which have hinge connection and can be tied folded for transport.

Ouellette discloses an infant bathing support with supportive straps for holding an infant and securing the board.

Walsh discloses a bathtub cushion of plural planar rectangular elements foldably hinged together with means for holding the elements in a predetermined adjustment relative to each other, and suction cup structure on the lower side.

Miller discloses an example of folded plastic sheet.

However, the present invention is believed to provide substantial, unique advantages including advantages indicated by the following objects of the invention.

Principal objects of the invention are to provide a portable changing surface for infants which is physically safe when set-up for use and gives visual evidence of such safety, which can be exceptionally wet-and-soil resistant when set-up and when folded for carriage or storage while at the same time particularly handy for carriage, in considerable part as result of unique dual-purpose rod structure; which is light weight, damage resistant, sanitary, size adaptable, economical to produce, ship and purchase, easy to use, and is attractive in appearance.

In brief summary given for cursive description only and not as limitation the invention includes plural panels hinged together and having longitudinally slidable rod structure for maintaining the panels co-planar.

The above and other objects and advantages of the invention will become more readily apparent on examination of the following description, including the drawings in which like reference numerals refer to like parts:

FIG. 1 is an isometric view showing two units of the invention respectively set up for use and folded for carriage, in an environment representing conditions encountered in travel with infants;

FIG. 2 is an isometric view showing typical details of the underside of the invention in folded configuration;

FIG. 3 is a side elevational view of the invention set up for use; and

FIG. 4 is a side elevational view of a further embodiment.

FIG. 1 shows the invention 10 set up for use in changing or otherwise attending an infant under conditions less than ideal frequently encountered in travel, as in a public toilet in which the only practicable support above the floor is a washstand W. The invention comprises three rigid rectangular and stably planar members 20, 22, 24 which may be nearly identical for economy in production and for economy in storage space when folded, and may be of lightweight structural plastic.

A pad 26 cemented to the planar members unites them in edge-to-edge alignment, preferably with a slight gap between. The pad may be of sealed lightweight foam rubber, foam plastic with a tough, impervious plastic cover, or other suitable rubber-like material relatively pliable but substantially cushioning.

Maintaining the three planar members in-plane with each other to form an overall planar working surface are two rod structures 28, 30, both in the form of a square "U," longitudinally slidable in parallel-spaced apertures 32, 34 in each end planar member. These are of a length to pass into similar apertures 36, 38 in the central planar member, when fully inserted to the first or maintaining position. Access for operation of the rod structures is at the ends, so that reaching under the unit is never required for setting up. or for folding by retraction of the rod structures to the second or fold position.

A pair of straps 40, 42 which may be fixed on opposite sides of the central planar member, provide for securing an infant to the unit.

Unit 10 at lower left shows folded configuration, with the ends or handles 28', 30' formed by the base of each squared "U"-shaped rod, extended as carrying handles, in the retracted position. The planar members may form a "Z" shape in side view when folded. Advantageously the lower handle 30' serves as a stand or means for preventing the unit from taking up water or soil from the floor. Similarly, the upper handle 28' when the unit is leaned at an angle, stands-off the remainder of the unit from the wall, so that it is easy to prevent fouling the cushion when the unit must be set down in such environments.

FIG. 2 shows flat suction cups 44 on the underside of each planar member to retard slippage, and further indicates how easily the folded configuration slips into a bag B when held by a handle. Details of the self-storage tie using the straps also appear.

FIG. 3 illustrates further details of the relations of the parts in set-up configuration. The handles fit flush with the ends so that accidental retraction is prevented; the rod is preferably of round cross-section, to provide a grip for retraction when flush.

Additionally the larger ends 28" on the rods prevent pulling out beyond counterbore 32' in the end planar members. Any other conventional arrangement can be used for the same purpose.

Because the overall structure is substantially symmetrical when set-up for use, the rod structures being opposed in the opposite ends and the infant securance being generally at the middle, confusion and loss of time are minimized and the unit can easily and safely be set up (or folded) in the dark, the positions of the parts being discerned by touch.

Size for the unit may be conveniently 12 × 24 inches (30 × 61 cm) overall, foldable to approximately one third the length, or to the approximate dimension of 16 × 8-plus inches.

FIG. 4 shows a further embodiment, 400, providing for all pad portions to fold inward for protection outside by planar members. Pad portion 426 is separate from the supporting planar member 420 and folds over the other pad portions first so that it lies between them when they fold as before described, and planar member 420 has pivotal connection 446 on the upper side, permitting it to fold in the opposite direction (arrows) for snug storage secured by suction cups against the adjacent planar member 422. Strap structure 440 secures the remainder of the unit. Thus a first of the plural planar members folds around to securance against a second such member, and the pad portion left unsupported folds inwardly over a second pad portion, which is then covered by a third pad portion with a third planar member over it.

In conclusion, the ease of assembly, economy, safety and sanitation of the invention will now be apparent together with other advantages such as trim appearance, durability, convenience, comfort for infants and simplicity.

The invention is not to be construed as limited to the particular forms disclosed herein, since these are to be regarded as illustrative rather than restrictive. It is, therefore, to be understood taht the invention may be practiced within the scope of the claims otherwise than as specifically described.

What is claimed and desired to be secured by United States Letters Patent is:

1. In a portable structure having plural members unfoldable in end-to-end configuration to form a surface upon which to support infants for changing, bathing and the like, the improvement comprising: means hinging said members together; and end accessible means for maintaining, at a first position, said plural members aligned when unfolded in end-to-end configuration, and for permitting, at a second position, folding of said plural members about the hinging means, the end-accessible means comprising a rod structure at each end of said configuration longitudinally slidable relative to said plural members in respective apertures therealong from said first position in which said rod structures together engage all said plural members to said second position in which each rod structure retracts to a respective end of said end-to-end configuration for permitting said folding.

2. In a portable structure as recited in claim 1, means for preventing said portable structure from taking up water or soil from a floor on which set, comprising a portion of the rod structure extending as a stand therefrom in said second position.

3. In a portable structure as recited in claim 2, means for securing an infant to the portable structure, comprising flexible elongate means fixed substantially at a middle portion of the elongate structure in position for retaining the portable structure in folded configuration when folded.

4. In a portable structure as recited in claim 2, said rod structure comprising squared "U"-shape with the base of the squared "U" shape forming handle structure for carrying the portable structure.

5. In a portable structure as recited in claim 4, all said plural members being planar.

6. In a portable structure as recited in claim 5, all said plural members forming a "Z" shape when the portable structure is folded.

7. In a portable structure as recited in claim 2, the means for hinging comprising a cushioning pad covering and affixed to all said plural members.

8. In a portable structure as recited in claim 2, first, second and third of said plural members, a pad positionable for support by all said plural members, a first of said plural members foldable on a said means hinging to a position against a second of said plural members, leaving a first portion of said pad unsupported, said first portion of the pad flexibly foldable over a second portion of the pad with a third portion of the pad, having a third of said plural members thereover, proportioned for folding over the second portion of the pad.

* * * * *